US006299327B1

(12) United States Patent
Camarota

(10) Patent No.: US 6,299,327 B1
(45) Date of Patent: Oct. 9, 2001

(54) LIGHT FIXTURE WITH MULTI-PURPOSE MOUNTING ARRANGEMENT

(75) Inventor: Richard J. Camarota, Holland, MI (US)

(73) Assignee: ITC, Inc., Holland, MI (US)

( * ) Notice: Subject to any disclaimer, the term of this patent is extended or adjusted under 35 U.S.C. 154(b) by 0 days.

(21) Appl. No.: 09/251,529

(22) Filed: Feb. 17, 1999

Related U.S. Application Data

(63) Continuation-in-part of application No. 09/172,312, filed on Oct. 14, 1998.

(51) Int. Cl.[7] ..... F21S 4/00

(52) U.S. Cl. ..... 362/219; 362/220; 362/225; 362/250; 362/404; 362/147; 362/260; 362/457; 362/368; 362/370

(58) Field of Search ..... 362/219, 220, 362/221, 250, 368, 370, 371, 239, 404, 147, 260, 457, 458, 225, 391

(56) References Cited

U.S. PATENT DOCUMENTS

| | | | | |
|---|---|---|---|---|
| 2,288,941 | * | 7/1942 | Curtis | 362/219 |
| 4,726,781 | * | 2/1988 | Bernhart et al. | 439/228 |
| 5,221,138 | * | 6/1993 | Bostjancic | 362/221 |
| 5,658,066 | * | 8/1997 | Hirsch | 362/219 |
| 5,702,176 | * | 12/1997 | Engle | 362/219 |

* cited by examiner

*Primary Examiner*—Sandra O'Shea
*Assistant Examiner*—Ali Alavi
(74) *Attorney, Agent, or Firm*—Benita J. Rohm; Raphael A. Monsanto; Richard A. Gaffin

(57) ABSTRACT

A lighting system for installation on a mounting surface employs a lighting fixture having a housing with a lamp therein, a roof, and sides. Each side is provided with an integrally formed receiver that defines a receiver aperture. A coupler has a mounting portion for coupling with a mounting surface and an engagement portion that resiliently engages with the receiver aperture. The mounting portion of the coupler mounts directly onto a mounting surface and engages with a metal bar of the type used in metal furniture, or mounts on a track that is interposed between the roof of the lighting fixture and the mounting surface. Track-mounted embodiments use a threaded fastener engaged with the coupler to exert a locking force on the inside surface of the mounting track. In a dual-mount arrangement, a fixture mounting arrangement formed of substantially planar portions offset from one another permits engagement with a track, or facilitates mounting on a surface. A wire management clip engages with the mounting track. Electrical connectors permit multiple lighting fixtures to be daisy-chained and controllable independently. A lamp socket supports the glass body of a high-output lamp to prevent it from sagging and contacting the protective lens or glass. An attachment element, such as a gooseneck permits fixture placement variation in one or more dimensions.

12 Claims, 10 Drawing Sheets

LIGHT FIXTURE WITH MULTI-PURPOSE MOUNTING ARRANGEMENT

RELATIONSHIP TO OTHER APPLICATION

This application is a continuation-in-part of U.S. Ser. No. 09/172,312, filed Oct. 14, 1998.

BACKGROUND OF THE INVENTION

1. Field of the Invention

This invention relates generally to lighting arrangements, and more particularly to a lighting arrangement that employs selectably dismountable lighting fixtures that may be interconnected in a daisy-chain fashion, and yet be independently controllable and with the interconnecting wiring being managed to maintain a neat appearance.

2. Description of the Related Art

Conventional lighting fixtures of the type that are used, for example, in furniture are configured and dimensioned for the particular application. Thus, small lighting fixtures are used to illuminate small spaces, and longer lighting fixtures are used for longer areas that need to be illuminated. It is a disadvantage of these known arrangements that once a lighting fixture is installed, it generally can not be displaced or otherwise reconfigured to accommodate the wishes of the user. There is a need, therefore, for a lighting system that permits the user to control the amplitude and arrangement of the illumination for his or her particular needs. Reconfiguration of the distribution of the light over a predetermined area to be illuminate can not generally be achieved with a single fixture.

It is often desired to discontinue illumination in a portion of the field to be illuminated. This generally can not be achieved by a single fixture that would illuminate the entire field. Known lighting arrangements that would use several, distributed fixtures typically provide for a single control for all such fixtures. Thus, all such lighting fixtures in the known arrangement are turned on and off simultaneously, or dimmed simultaneously. Efforts to effect control over each such lighting fixture independently of the others results in the need to install a separate power wire for each such fixture. In an installation where multiple lighting fixtures are employed, management of the power wires becomes a problem. There is a need, therefore, for a lighting system that permits each of a plurality of individual lighting fixtures to be controlled independently of the others while permitting management of the power wiring to maintain a neat appearance.

It is, therefore, an object of this invention to provide a lighting arrangement wherein individual lighting fixtures therein can readily be displaced to effect a desired distribution of lighting.

It is another object of this invention to provide a lighting arrangement that permits individual ones of the lighting fixtures therein to be controlled independently of one another by a user.

It is also an object of this invention to provide a lighting arrangement for premanufactured furniture wherein one or more lighting fixtures can readily be installed after shipment and delivery of the furniture at a remote location, without requiring the lighting fixtures to be shipped therewith.

It is a further object of this invention to provide a lighting fixture that provides a safe support for a high-output lamp, whereby the lamp is precluded from coming into contact with portions of the fixture that cannot withstand the operating temperatures achieved by the high-output lamp.

It is additionally an object of this invention to provide an electrical interconnection arrangement for a plurality of lighting fixtures wherein a daisy-chained electrical interconnection scheme can be implemented.

It is yet a further object of this invention to provide a mounting arrangement for a lighting fixture wherein a predetermined minimum space between the lighting fixture and a mounting surface is maintained.

It is also another object of this invention to provide a lighting arrangement for premanufactured furniture wherein one or more lighting fixtures can securely be held in place during shipment of the furniture.

It is yet an additional object of this invention to provide a mounting arrangement for a lighting system that permits multiple modes for mounting a lighting fixture onto a surface, including mounting onto steel furniture.

SUMMARY OF THE INVENTION

The foregoing and other objects are achieved by this invention which provides, in a first apparatus aspect thereof, a lighting system for installation on a mounting surface. The lighting system is of the type having at least one lighting fixture having a housing with a lamp therein. The housing is provided with a roof and first and second exterior sides. In accordance with the invention, a first receiver portion is coupled to the first exterior side of the lighting fixture. The receiver portion defines a receiver aperture that extends along the first exterior side of the lighting fixture. There is additionally provided a coupler having a mounting portion for coupling with the mounting surface, and an engagement portion for engaging with the first receiver portion.

In one embodiment of the invention, the receiver portion is formed integrally with the housing. Additionally, the mounting portion and the engagement portion of the first coupler are also integrally formed. In a preferred embodiment, the first coupler is formed of a plastic material, whereby the engagement portion can be configured to be resiliently engageable with the first receiver portion.

In a particularly advantageous embodiment of the invention, the mounting portion is configured to form a spacer between the roof of the lighting fixture and the mounting surface. In one embodiment, the mounting portion of the first coupler extends over a portion of the roof of the lighting fixture, and has a thickness that corresponds to the desired spacing to be maintained between the roof of the lighting fixture and the mounting surface.

In a multiple fixture embodiment of the invention, there is provided a further lighting fixture, each of the lighting fixtures being provided with a first electrical connector for receiving electrical energy. Additionally, each of the lighting fixtures, in this embodiment, is provided with an electrical switch for controlling the delivery of electrical energy to the respectively associated lighting fixture. Thus, each such lighting fixture is independently controllable. In a further embodiment, each of the lighting fixtures is provided with a second electrical connector, thereby permitting the lighting fixtures to be electrically interconnected in a daisy-chain fashion.

In a further embodiment of this first aspect of the invention, the lighting fixture is provided with a high output lamp, such as a halogen lamp. The lamp is installed in a lamp socket, which preferably is of the type that can withstand elevated operating temperatures. The lamp socket is provided with a lamp support, such as a protruding shoulder, that supports the lamp in a predetermined orientation. The support for the high-output lamp prevents the lamp from sagging and thereby communicating with a portion of the lighting fixture, such as a translucent cover therefor, which would be damaged by the high operating temperature of the high-output lamp.

In a further embodiment of the invention, there is provided a second receiver portion coupled to the second exterior side of the lighting fixture. The second receiver portion defines a receiver aperture that extends along the second exterior side of the lighting fixture. In this embodiment, there is additionally provided a second coupler having a mounting portion for coupling to the mounting surface and an engagement portion for engaging with the second receiver portion. The first and second couplers, preferably are identical to one another, so as to reduce manufacturing cost.

In a further embodiment of the invention, there is provided a track mounting arrangement that is interposed between the mounting portion of the first and second couplers and the mounting surface. The first and second couplers are slidably displaceable along the track mounting arrangement. In a highly advantageous embodiment, the first and second couplers are each provided with a threaded aperture therethrough for accommodating respective threaded locking elements. The threaded locking elements engage with respective ones of the threaded apertures for applying a bias force against the track mounting arrangement, whereupon the first and second couplers are fixed at respective locations along the track mounting arrangement.

In addition to the foregoing, an embodiment of the invention is provided with a power wire for delivering electrical energy to the lighting fixture, and there is additionally provided a plurality of wire guideway elements for retaining the power wire in substantially fixed relation to the track mounting arrangement. The wire guideway elements are each coupled to the track mounting arrangement.

In a still further embodiment, the mounting portions of the first and second couplers are provided with a respective aperture therethrough for facilitating the fixing thereof at respective locations on the mounting surface.

In a highly advantageous embodiment of the invention, there is further provided an elongated support attachment having first and second ends coupled to respective mounting portions of said first and second couplers. The elongated support attachment and the first and second couplers are, in some embodiments, integrally formed. A telescopic displacement arrangement having first and second telescopically displaceable engaged portions is provided for coupling the elongated support attachment to the mounting surface. In this manner, the elongated support attachment and the lighting fixture coupled thereto can be positioned at a determined variable distance with respect to the mounting surface.

In accordance with a further aspect of the invention, there is provided a lighting system for installation on a mounting surface, the lighting system being of the type having at least one lighting fixture having a housing with a lamp therein. The housing has a roof and first and second exterior sides. In accordance with the invention, there is provided a first receiver portion coupled to the first exterior side of the lighting fixture, the receiver portion defining a receiver aperture extending along the first exterior side of the lighting fixture. There is additionally provided a first coupler having a mounting portion for coupling with the mounting surface and an engagement portion for engaging with the first receiver portion. The engagement portion is resiliently and removably engageable with the first receiver portion. Additionally there is provided a track mounting arrangement interposed between the mounting portion of the first coupler and the mounting surface. The first coupler is slidably engageable with the track mounting arrangement so as to be displaceable therealong.

In one embodiment of the invention, there is provided a locking arrangement for fixing the engagement portion at a desired location along the track mounting arrangement. The mounting portion of the first coupler is provided with a threaded aperture therethrough, and a first threaded locking element engages with the threaded aperture for fixing the coupler at a predetermined location along the track mounting arrangement.

The mounting portion of the first coupler, in this embodiment, is configured to form a spacer between the roof of the lighting fixture and the mounting surface, as previously described. There is additionally provided a power wire for delivering electrical energy to the lighting fixture, the power wire being guided via a plurality of wire guideway elements. The wire guideway elements are coupled to the track mounting arrangement, and serve to retain the power wire in substantially fixed relation with respect to the track mounting arrangement.

In accordance with a further aspect of the invention, there is provided a lighting system for installation on a mounting surface, the lighting system being of the type having a plurality of lighting fixtures, each having a housing with a lamp therein. Each of the housings has a roof and first and second sides. In accordance with the invention, there are provided first and second receiver portions coupled to respective ones of the first and second exterior sides of each lighting fixture. Each receiver portion serves to define a receiver aperture that extends along the associated one of the first and second exterior sides of the respectively associated lighting fixture. There are additionally provided a plurality of couplers each having an associated mounting portion for coupling with the mounting surface and maintaining the roof of the respectively associated lighting fixture at a predetermined distance away from the mounting surface, and an engagement portion for removably engaging with a respectively associated one of the first and second receiver portions. At least two electrical connectors are installed in each of the housings of the plurality of lighting fixtures. The electrical connecters facilitate electrical interconnection of the lighting fixtures in a daisy-chain fashion. A switch arrangement controls the delivery of electrical energy to each lighting fixture independently.

In one embodiment of this invention, the switch arrangement is formed of a plurality of switches each associated with a respective one of the plurality of lighting fixtures. In a preferred embodiment, each switch has multiple "ON" states, whereby control over the magnitude of the illumination is achieved.

As previously described, there are provided a plurality of power wires for electrically interconnecting the plurality of lighting fixtures. A track mounting arrangement is interposed between the mounting portion of the first coupler and the mounting surface. The first coupler is slidably engageable with the track mounting arrangement so as to be displaceable therealong. Additionally, a plurality of wire guideway elements, each coupled to the track mounting arrangement is provided for retaining the plurality of power wires in substantially fixed relation with respect to the track mounting arrangement. Further in this embodiment, the track mounting arrangement is provided with a first elongated track portion for engaging with the engagement portions of the plurality of couplers, and a second elongated track portion, that is arranged parallel to the first elongated track portion, for engaging with the plurality of wire guideway elements.

In a further embodiment, the first and second elongated track portions of the track mounting arrangement are formed integrally with one another. They may be formed of a polymeric material.

In one embodiment, the track mounting arrangement is installed using a plurality of fasteners. One of the fasteners, which may be, for example, a pan head screw, is configured as an end stop for precluding inadvertent disengagement of the coupler from the track mounting arrangement.

In accordance with a further aspect of the invention, a dual purpose fixture mounting arrangement is provided for attaching a lighting fixture, illustratively to a mounting surface or to a track. The lighting fixture, as previously stated, is of the type having a housing with a roof portion. The fixture mounting arrangement is provided with a mounting element having a first substantially planar portion adapted to be affixed to the roof portion of the lighting fixture. A second substantially planar portion is disposed offset from the first substantially planar portion in a direction away from the roof portion of the lighting fixture. The second substantially planar portion is provided with a threaded aperture therethrough.

In one embodiment of this further aspect of the invention, there is provided a second substantially planar portion having a further aperture for accommodating therethrough a fastener for attaching the lighting fixture to a mounting surface. Preferable, the aperture is configured to have an enlarged region that will accommodate the head of the fastener, and a contiguous narrower region that, when the second substantially planar portion is slid under the partially pre-engaged fastener, will permit the head of the fastener to support the lighting fixture. Then, the fastener can be tightened in a conventional manner to secure the fixture mounting arrangement and the lighting fixture attached thereto to the mounting surface.

In a further embodiment, the second substantially planar portion is provided with a laterally extended portion, and there is further provided a track adapted to be installable on a mounting surface. The laterally extended portion of the second substantially planar portion is configured to engage with the track and to be slidably displaceable therealong. The track is provided with a plurality of apertures therethrough for accommodating a corresponding plurality of fasteners, whereby the track is installed on the mounting surface. In this embodiment, there is further provided a threaded locking element for engaging threadedly with the threaded aperture through the second substantially planar portion for applying a locking force against the track. In this manner, the lighting fixture is fixed at a desired location along the track.

In accordance with a still further aspect of the invention, there is provided a lighting system for installation on a mounting surface. The lighting system is of the type having at least one lighting fixture having a housing with a lamp therein, the lighting fixture the lighting system. In accordance with this aspect of the invention, there is provided a base housing having a roof and first and second exterior sides. A first receiver portion is coupled to the first exterior side of the base housing, the receiver portion defining a receiver aperture extending along the first exterior side of the lighting fixture. Additionally, there is provided a first coupler that is itself provided with a mounting portion for coupling with the mounting surface, and an engagement portion for engaging with the first receiver portion. Additionally, a flexible interconnection element couples the lighting fixture to the base housing.

In one embodiment of this further aspect of the invention, the flexible interconnection element is in the form of a flexible hollow tubular gooseneck that facilitates selection of distance and orientation of the lighting fixture with respect to the base housing.

As previously noted, there is provided an embodiment wherein the first receiver portion is formed integrally with said base housing, and the engagement portion is resiliently engageable with the first receiver portion.

BRIEF DESCRIPTION OF THE DRAWING

Comprehension of the invention is facilitated by reading the following detailed description, in conjunction with the annexed drawing, in which.

DETAILED DESCRIPTION

Figure 1:
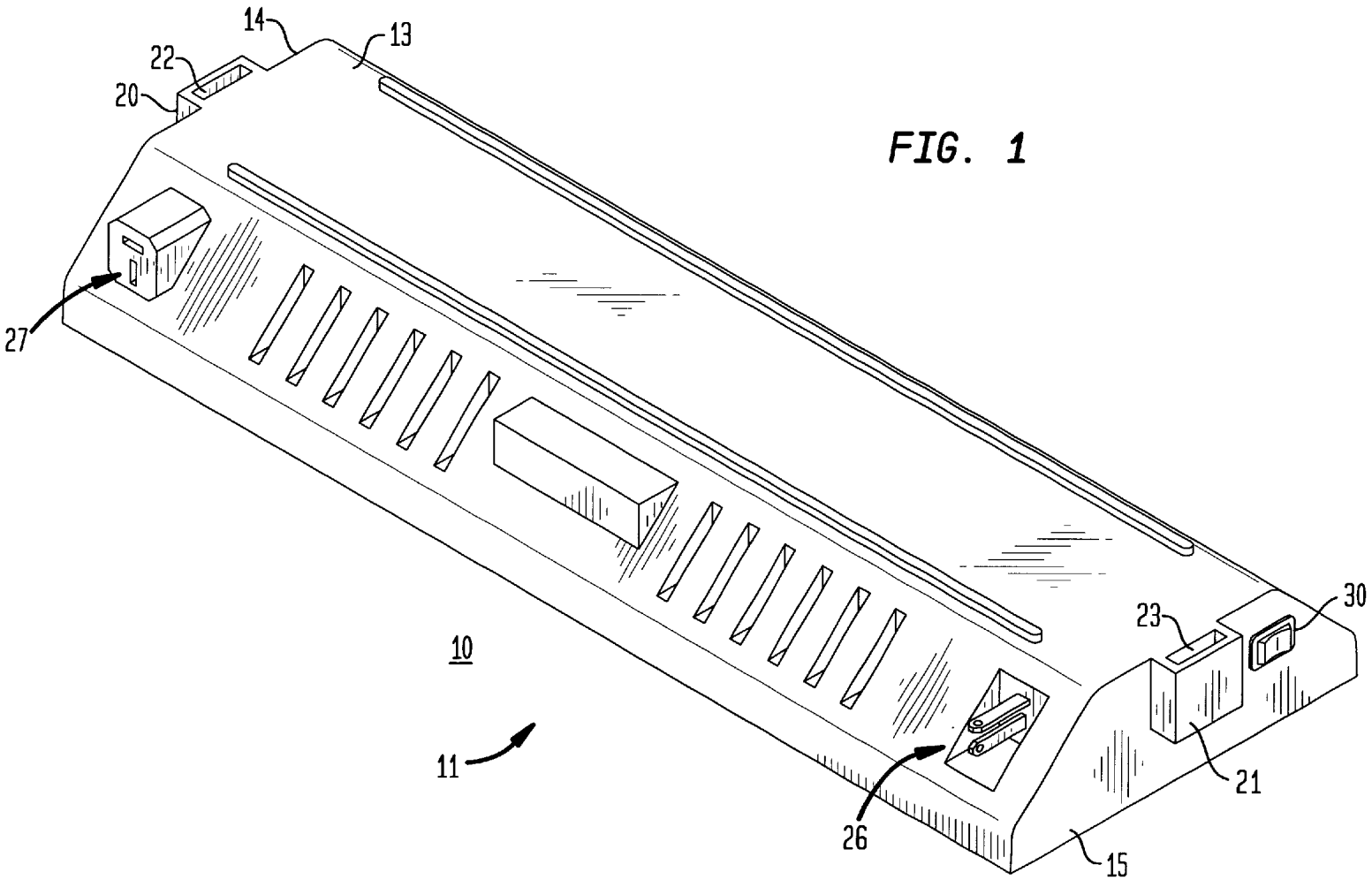
FIG. 1 is an isometric representation of a lighting fixture constructed in accordance with the principles of the invention.

Comprehension of the invention is facilitated by reading the following detailed description in conjunction with the annexed drawing, in which:

FIG. 1 is an isometric representation of a lighting fixture 10 having a housing 11. The housing is provided with a roof 13, a first exterior side 14 (not visible in this figure), and a second exterior side 15.

Each of exterior sides 14 and 15 is provided with a respective one of receiver portions 20 and 21, each of which defines a respective one of receiver apertures 22 and 23. Receiver apertures 22 and 23 are configured to accommodate a coupler, as will be described hereinbelow with respect to FIG. 2 and FIGS. 3A to 3D.

Lighting fixture 10 is additionally provided, in this specific illustrative embodiment of the invention, with a male electrical connector 26 and a female electrical connector 27. As shown, male and female electrical connectors 26 and 27 are not of a standard type to prevent inadvertent electrical coupling with unintended voltages. In operation, the lamp arrangement of lighting fixture 10, which will be discussed hereinbelow with respect to FIG. 4, can be configured to be operable at any of a variety of predetermined voltages, illustratively 12 volts, 24 volts, 120 volts, etc. Thus, in a 12 volt embodiment of the invention, for example, a standard 120 volt female plug cannot be coupled to male electrical connector 26.

The delivery of electrical energy to the lamp (not shown in this figure) is controlled by a switch 30 having on and off electrical states. In some embodiments of the invention, however, switch 30 may have multiple on states, each such state resulting in a different level of illumination by the lighting fixture. Of course, a continuous dimmer circuit may be employed with, or as an alternative to, switch 30.

Figure 2:
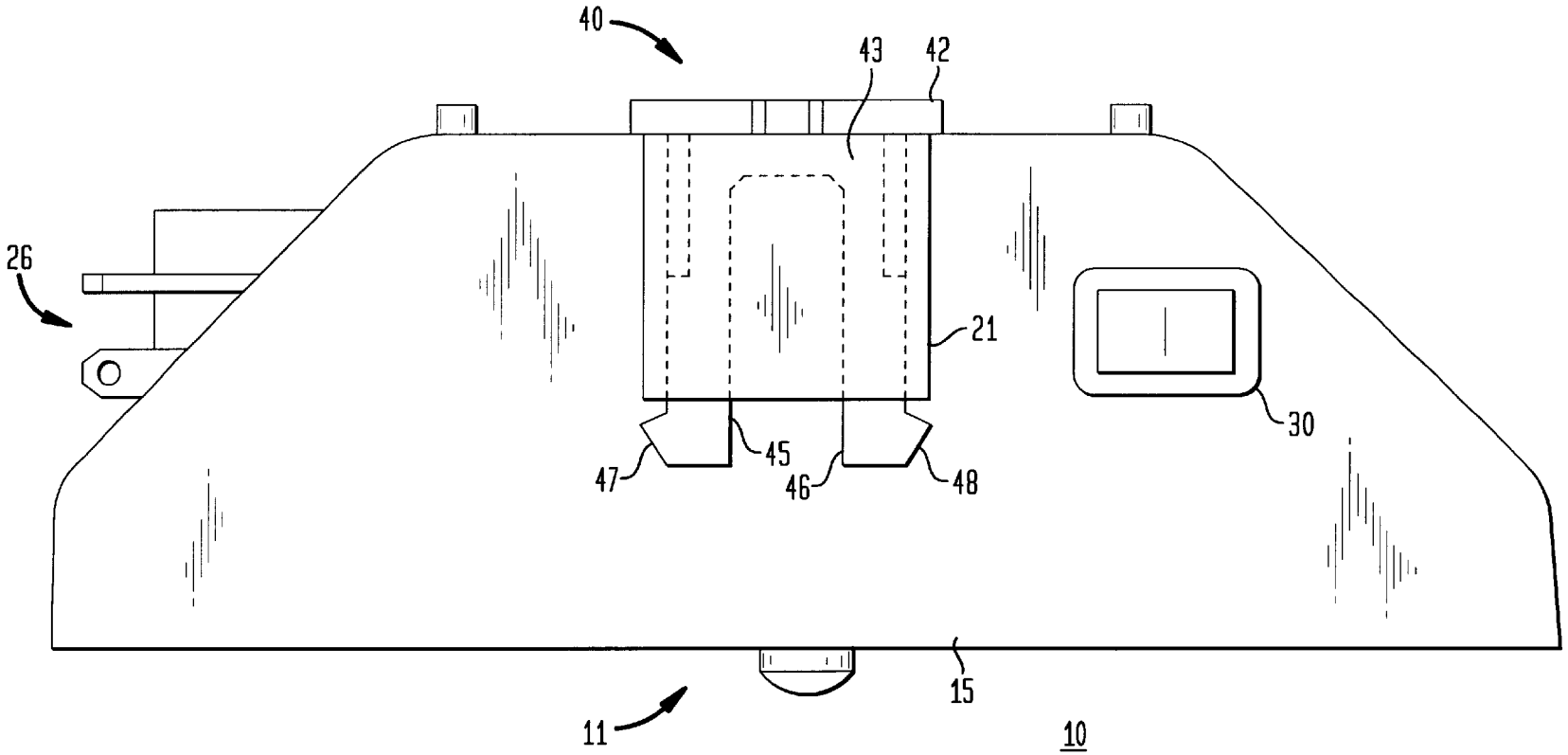
FIG. 2 is an end view of the embodiment of FIG. 1.

FIG. 2 is an end view of lighting fixture 10 showing second exterior side 15. Elements of structure that have previously been discussed are similarly designated. This figure shows a coupler 40 accommodated with receiver portion 21. Coupler 40 has a mounting portion 42 that, as will be described hereinbelow with respect to FIGS. 3A to 3D, serves to enable attachment of the coupler, and consequently lighting fixture 10, to a mounting surface (not shown in this figure). Coupler 40 is additionally provided with an engagement portion 43 that is provided with legs 45 and 46. These legs are formed of a resilient material such that, as coupler 40 is inserted into receiver portion 21, they will yield inwardly resiliently by operation of sloping portions 47 and 48 which form terminations of legs 45 and 46, respectively.

Figure 3A:
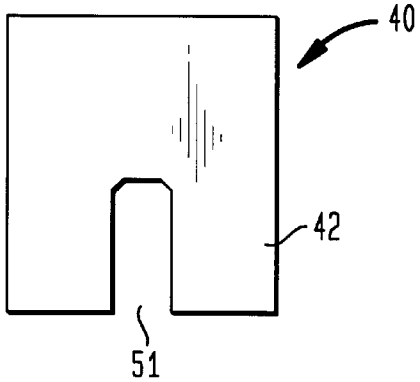
FIGS. 3A–3D are representations of a coupler that is useful for attaching the lighting fixture of FIG. 1 to a mounting surface or a track.
Figure 3B:
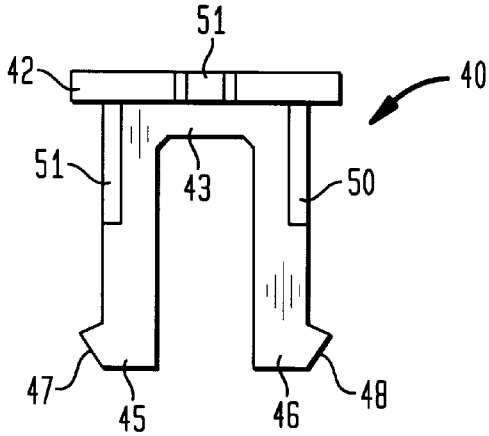
Figure 3C:
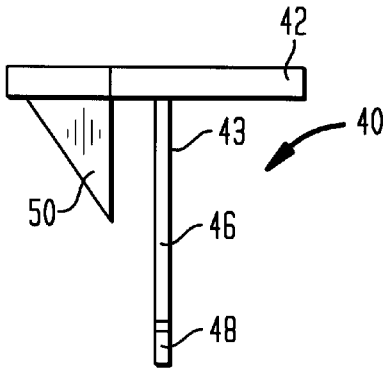
Figure 3D:
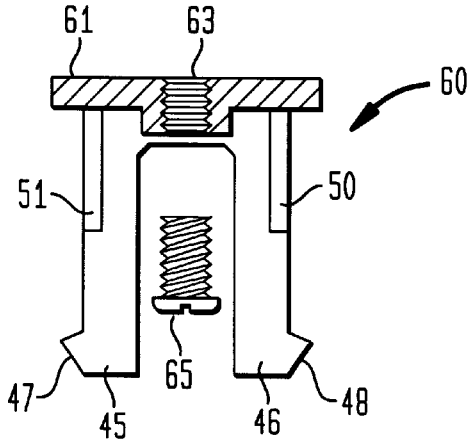

FIGS. 3A to 3C show various embodiments of coupler 40. FIG. 3D shows a further embodiment of a coupler that is similar to coupler 40.

Referring to FIG. 3A, there is shown a top view of coupler 40 showing specifically mounting portion 42. In this specific embodiment, mounting portion 42 is provided with a slot 51 for accommodating a fastener whereby the coupler is secured to a mounting surface (not shown). FIG. 3B is a front view of coupler 40, showing engagement portion 43, legs 45 and 46, and sloping portions 47 and 48. As previously stated, engagement portion 43, and specifically legs 45 and 46, are formed, in this specific embodiment, of a resilient material, such as a plastic or other elastomeric material, whereby legs 45 and 46 will yield resiliently inwardly toward one another during insertion into receiver portion 21, as shown in FIG. 2.

FIG. 3C is a side representation of coupler 40 showing mounting portion 42 and engagement portion 43 from the side of leg 46. This figure additionally shows a support protuberance 50. A further support protuberance 51 is arranged in the vicinity of leg 45, as shown in FIG. 3B. A metal bar (not shown) of the type used in metal furniture is accommodated between the legs of the coupler and support protuberances 50. Mounting portion 42, in addition to facilitating the mounting of lighting fixture 10 to a mounting surface (not shown) additionally serves as a spacer whereby roof 13 of lighting fixture 10 is maintained at a distance from the mounting surface, or a mounting track, as will be described hereinbelow with respect to FIGS. 5 and 7. The gap that is produced by operation of the spacing of mounting portion 42 reduces the heat that is conducted to the mounting surface by the lamp, particularly a high-output lamp, as will be discussed hereinbelow with respect to FIG. 4.

FIG. 3D is a front plan view of a coupler 60 that is similar in several respects to coupler 40, described hereinabove. Accordingly, correspondingly analogous elements of structure in coupler 60 to those described hereinabove with respect to coupler 40 are similarly designated. The principle difference in this embodiment of the invention from that described hereinabove is in the mounting portion, designated 61 herein which is shown cross-sectionally to have a threaded aperture 63 therethrough. Threaded aperture 63 accommodates a threaded fastener 65 for locking against a track, the track being described hereinbelow with respect to FIGS. 5 and 7. Of course, a fastener that does not engage threadedly with threaded aperture 63, such as a wood screw (not shown), can be accommodated within the aperture for effecting direct affixation of the lighting fixture to the mounting surface (not shown).

Figure 4:
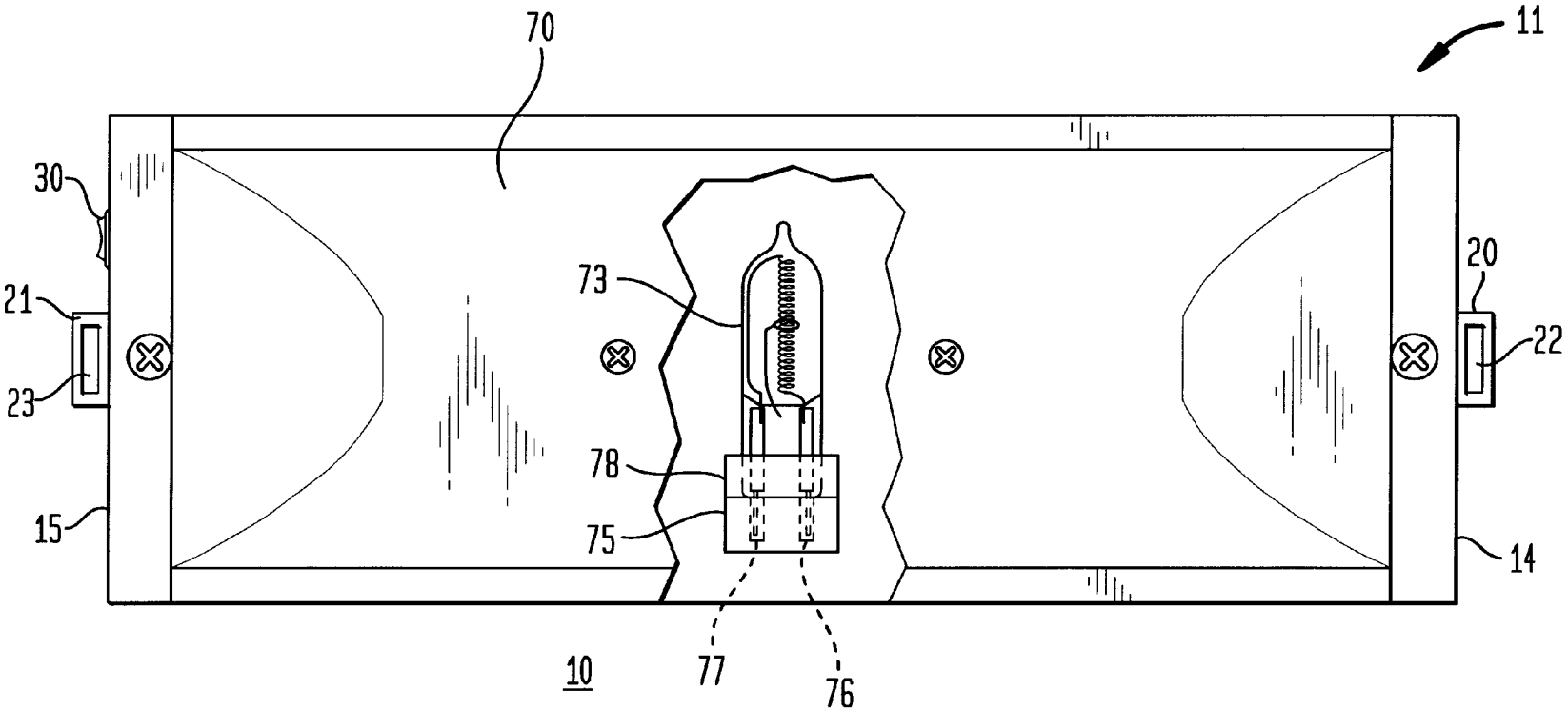
FIG. 4 is a plan view of the underside of the lighting fixture of FIG. 1 showing a lamp supported lamp socket.

FIG. 4 is a plan view of lighting fixture 10 showing a translucent lens 70, which may be a sheet of glass. In this figure, translucent lens 70 is shown to be broken away to reveal a lamp 73 installed within a lamp socket 75. In this embodiment, lamp 73 is a high-output lamp, such as a halogen lamp, and is shown to have a pair of contacts 76 that are accommodated within respective sockets 77 of lamp socket 75. In this embodiment, lamp socket 75 is additionally provided with a shoulder portion 78 that accommodates a portion of the glass or quartz body (not specifically designated) of lamp 73. Such support prevents the lamp from sagging after being heated for extended periods of time and ultimately contacting translucent lens 70. The translucent lens will generally not be able to withstand the temperatures generated by the lamp, and may eventually become damaged, such as by cracking or becoming discolored. Thus, shoulder portion 78 of lamp socket 75 serves to extend the overall operating life of lighting fixture 10. In addition, shoulder portion 78 prevents the fingers of an operator (not shown) from contacting electrical contacts 76 during installation or removal of lamp 73.

In this embodiment of the invention, lamp sockets 77 are slotted to accommodate a range of distances between contacts 76. Thus, although different standards are emerging for inter-contact distances between high voltage and low voltage lamps, electrical safety considerations are nevertheless observed by the use of atypical connectors, such as male electrical connector 26 and female electrical connector 27 (FIG. 1).

Figure 5:
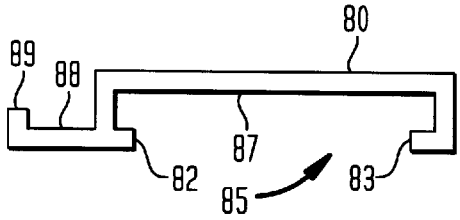
FIG. 5 is an end view of a track that is useful for installing the lighting fixture onto a mounting surface.

FIG. 5 is an end view of a mounting track 80 that is useful to install lighting fixture 10 to a mounting surface (not shown), such as the underside of a cabinet or other furniture. The mounting track has inward flanges 82 and 83 that serve to define a space 85 that accommodates the mounting portion of the coupler as described hereinabove, illustratively mounting portion 42 of coupler 40 and/or mounting portion 61 of coupler 60. Referring for the moment to coupler 60 of FIG. 3D, mounting portion 61 is accommodated slidably within space 85, such that the lateral extremities of the mounting portion are bounded by flanges 82 and 83. The coupler is fixed at a predetermined location by tightening of fastener 65 within threaded aperture 63 so as to exert a binding force against inner surface 87 of the mounting track.

Mounting track 80 is additionally provided with a lateral flange 88 having an upward flange 89 extending upwardly therefrom. In one embodiment of the invention, mounting track 80 with lateral flange 88 and upward flange 89 are integrally formed of a plastic or other elastomeric material that has a resilience characteristic.

Figure 6A:
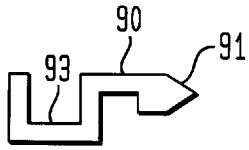
FIGS. 6A and 6B are end view of respective embodiments of power wire guideways that are useful for managing the power wire.

FIG. 6A is a side representation of a power wire guideway 90. The power wire guideway clip has a beveled edge 91 which can be urged over and engaged with upward flange 89 of mounting track 80. Power wire guideway 90 is provided with a channel 93 that accommodates a power wire that would supply electrical energy to one or more lighting fixtures, such as lighting fixture 10.

Figure 6B:
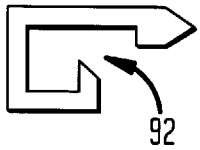

It is to be understood that other configurations of the power wire guideway clip can be employed in the practice of the invention. For example, FIG. 6B illustrates that the power wire guideway clip can be configured to extend downward as a C-channel 92, as opposed to the embodiment of FIG. 6A which serves to retain the power wire within a space 93 that is bounded in part by the mounting surface (not shown).

Figure 7:
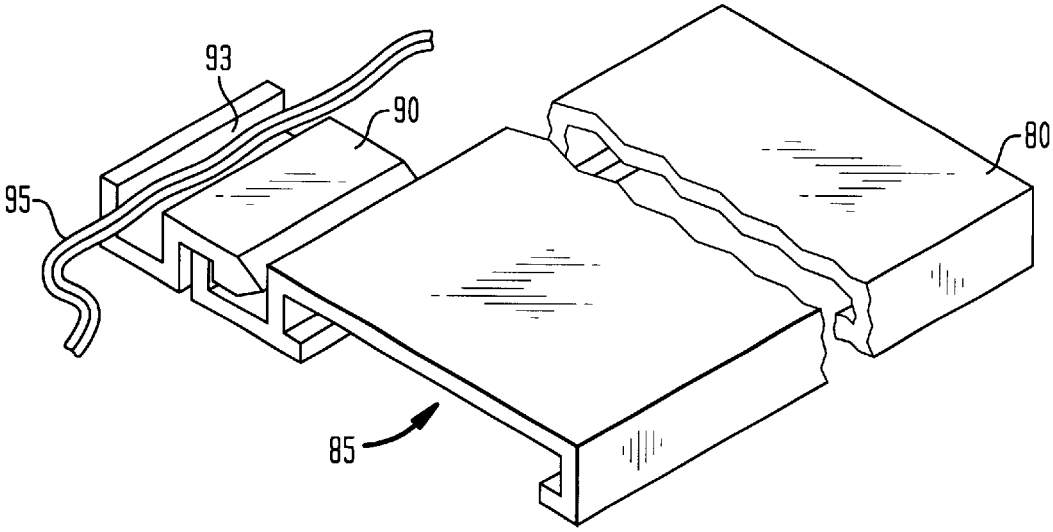
FIG. 7 is an isometric representation showing the power guideway of FIG. 6A coupled to the track of FIG. 5, and further showing the manner in which a power wire is maintained in fixed relation to the track.

FIG. 7 is an isometric representation of mounting track 80 shown with power wire guideway 90 engaged therewith. A power wire 95 is shown disposed in channel 93 of power wire guideway 90. As shown, mounting track 80 is of indeterminate length, depending upon the application. In an embodiment of the invention where the lighting fixture is desired to be installed under a cabinet, for example, the mounting track may extend along the entirety of the cabinet. In this embodiment, however, power wire guideway 90 is shown to have a much shorter length, and functions as a clip that is engaged with the mounting track to maintain power wire 95, and possibly other wires, in fixed relation to mounting track 80, so as provide a neat appearance while affording easy reconfiguration of the locations of the lighting fixtures (not shown in this figure).

The coupling of mounting track 80 to the mounting surface (not shown) is effected by a plurality of fasteners (not shown) which may be flat head wood screws, in cases where the mounting track is installed in wood furniture. Inner surface 87, in such a embodiment, would have apertures therethrough (not shown) that are countersunk so that the fastener heads do not interfere with the sliding of the mounting portions (e.g., 42 or 61) within the mounting track. However, certain ones of the fasteners may be of the pan head type, particularly near the ends of the mounting track, to prevent inadvertent sliding out of the couplers (e.g., 40 or 60).

It is evident from the foregoing that coupler sections 40 and 60 permit lighting fixtures to be mounted in a variety of ways. First, conventional screws, such as wood screws, can be inserted through slot 51 of coupler 40 or threaded aperture 63 of coupler 60, directly into the mounting surface (not shown). Alternatively, a metal bar (not shown) can be fitted into slot 51 of coupler 40. Such a metal bar installation is commonplace in conjunction with metal furniture. In addition, the coupler can be used with a track system, as shown in FIG. 7, which may include the wire management arrangement afforded by power wire guideway 90.

Lighting fixture 10 is advantageously electrically connected so as to be connectable in a daisy-chain fashion. Thus, the power wiring that connects various lighting fixtures within a multi-fixture installation is accommodated by the wire management arrangement. Each such lighting fixture, however, is individually controllable by its associated switch 30, as the wiring within each light may be in parallel interconnection form, rather than series. The resilient coupling afforded by the legs of the coupler permits each lighting fixture to be easily removed from the track system, or the mounting surface, to permit lamp replacement.

Figure 8:
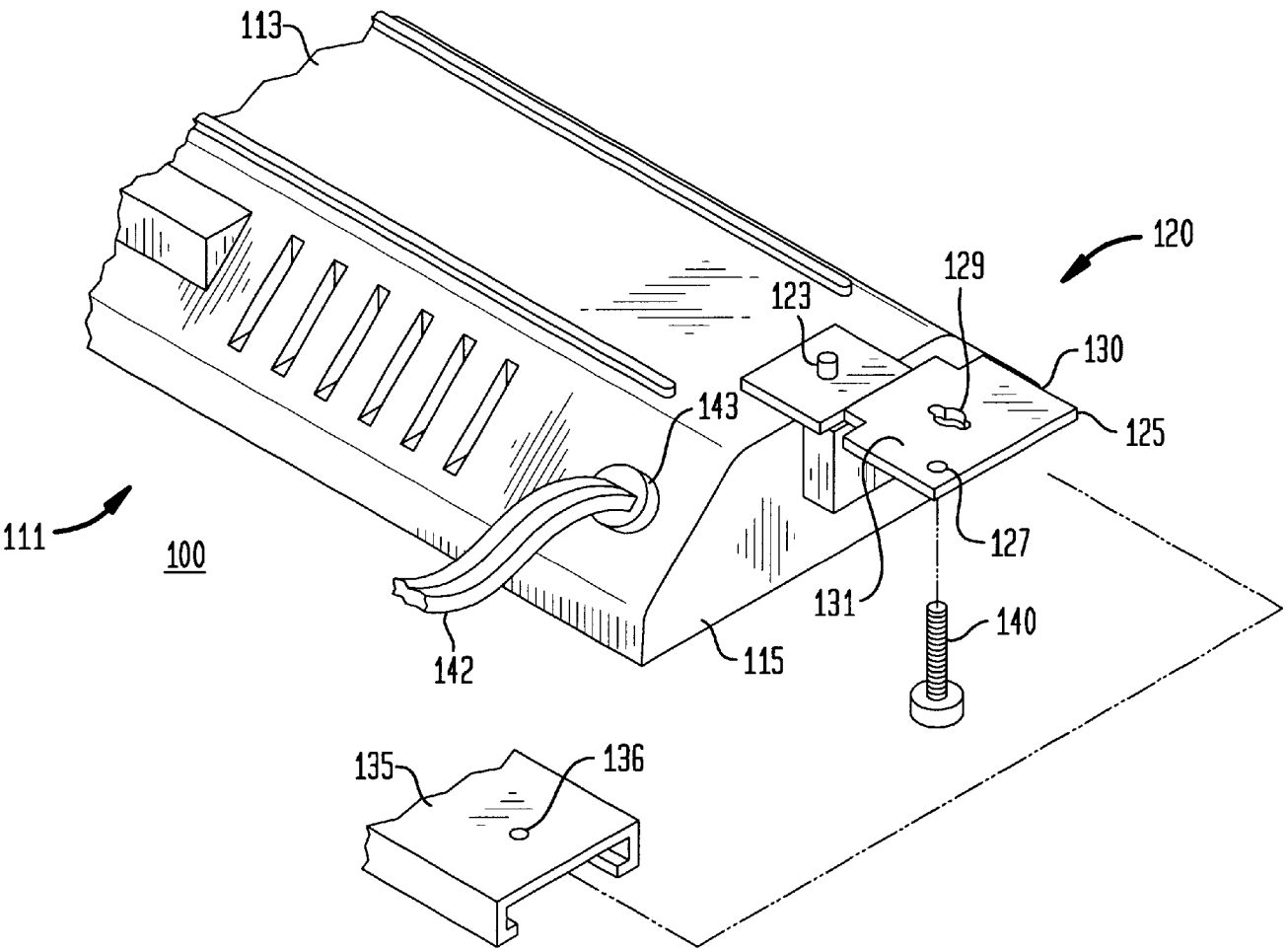
FIG. 8 is a fragmented isometric representation of a dual-mount arrangement for a lighting fixture wherein track mounting and direct mounting to a mounting surface are facilitated.

FIG. 8 is a fragmented isometric representation of a dual-mount arrangement for a lighting fixture wherein track mounting and direct mounting to a mounting surface are facilitated. As shown, a lighting fixture 100 is provided with a housing 111. The housing is provided with a roof portion 113, a first exterior side that is not visible in this figure, and a second exterior side 115. A fixture mounting arrangement 120 has a first substantially planar portion 123 adapted to be affixed to roof portion 113 of lighting fixture 100. A second substantially planar portion 125 is disposed so as to be offset vertically from first substantially planar portion 123 in a direction away from roof portion 113 of the lighting fixture. The second substantially planar portion is provided with a threaded aperture 127 therethrough. Preferably, fixture mounting arrangement 120 is formed of metal. Also, in a preferred embodiment, a correspondingly analogous fixture mounting arrangement (not shown in this figure) is provided on roof portion 113 in the vicinity of the first exterior side.

Second substantially planar portion 125 is provided with a further aperture 129 for accommodating therethrough a fastener (not shown) for attaching the lighting fixture to a mounting surface (not shown). The aperture, in this specific illustrative embodiment of the invention, is configured to have an enlarged central region that will accommodate the head of the fastener (not shown), and a contiguous narrower region on each side thereof that, when the second substantially planar portion is slid under the partially pre-engaged fastener, will permit the head of the fastener to support the lighting fixture. Then, the fastener (not shown) can be tightened in a conventional manner to secure the fixture mounting arrangement and the lighting fixture attached thereto to the mounting surface.

In a highly advantageous embodiment of the invention, second substantially planar portion 125 is provided with laterally extended portions 130 and 131, and there is further provided a track 135 adapted to be installable on the mounting surface (not shown ). The laterally extended portions of the second substantially planar portion are configured to engage with track 135 and to be slidably displaceable therealong. A plurality of apertures, such as aperture 136, are provided through the top surface of the track for accommodating a corresponding plurality of fasteners (not shown), whereby the track is installed on the mounting surface.

Once laterally extended portions 130 and 131 of second substantially planar portion 125 are engaged within track 35, a threaded locking element 140 engages threadedly with threaded aperture 127 so as to extend from the underside of the second substantially planar portion to a point thereabove, whereby a locking force is applied against the inside surface of the track. In this manner, the lighting fixture is fixed at a desired location along the track.

Also in this embodiment of the invention, electrical power is delivered to lighting fixture 100 by a power wire 142 that is shown to enter housing 111 via a conventional stress relief arrangement 143. The power management arrangement described hereinabove in connection with FIGS. 5–7 can be employed in the practice of this specific illustrative embodiment of the invention. Additionally, the dual purpose mounting arrangement described in FIG. 8 can readily be employed with lighting fixtures that are electrically interconnectable in a daisy-chain manner, as described hereinabove in connection with FIG. 1 which employs atypical male and female electrical connectors 26 and 27.

Figure 9:
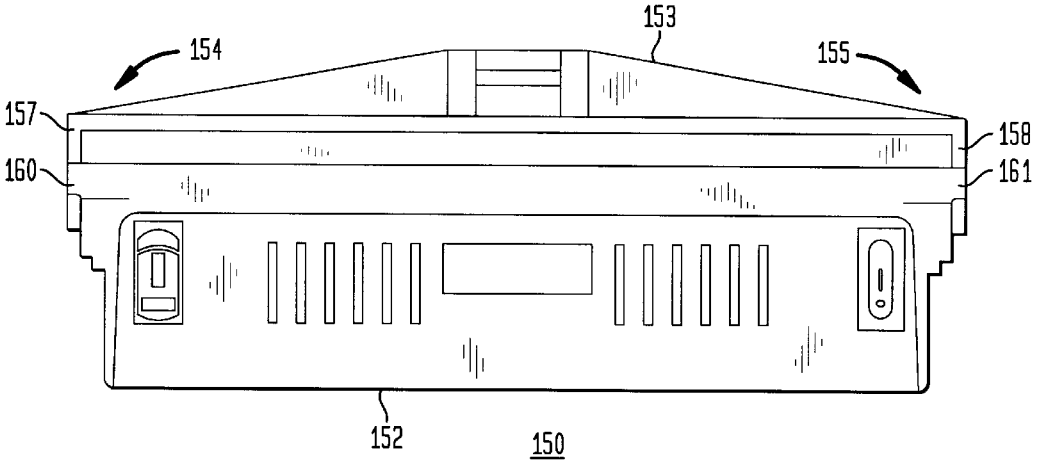
FIG. 9 is a plan side view of a lighting fixture showing an elongated support attachment that is coupled at its ends to respective couplers.

FIG. 9 is a side view of a lighting system 150 having a lighting fixture 152 that is shown to be coupled to an attachment element 153. As shown, attachment element 153 has first and second ends 154 and 155 that are coupled to respective ones of mounting couplers 157 and 158. The mounting couplers are engaged with respective receiver portions 160 and 161, which function substantially as discussed hereinabove with respect to FIGS. 1–4.

Figure 10:
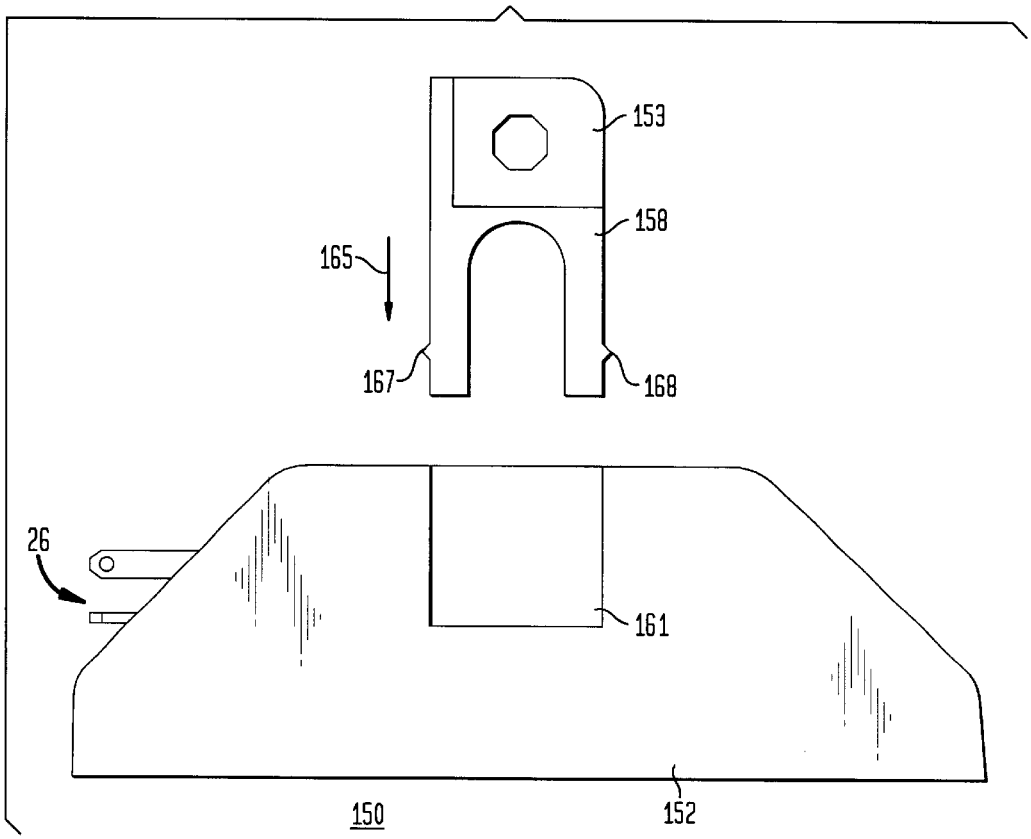
FIG. 10 is an end view showing the elongated support attachment coupled to a coupler and about to be engaged with a receiver portion at the end of the exterior side of the lighting fixture.

FIG. 10 is an end view of the embodiment of lighting system 150 showing the manner in which attachment member 153 and mounting coupler 158, which in this embodiment is integrally formed therewith, engage with receiver portion 161 of lighting fixture 152. Elements of structure that previously have been discussed are similarly designated.

Engagement of mounting coupler 158 within receiver portion 161 is achieved by urging the mounting coupler in the direction of arrow 165. A resilient yet firm engagement is achieved by operation of protuberances 167 and 168 which function in a manner similar to that described hereinabove with respect to sloping portions 47 and 48 (FIG. 2). Persons of skill in the art can configure the dimensions of protuberances 167 and 168 in response to the resilience characteristics of the materials being employed in a highly advantageous embodiment of the invention, the attachment element and the mounting couplers are integrally formed of a plastic material. Similarly, lighting fixture 152 and receiver portions 160 and 161 are also formed of a plastic material.

Figure 11:
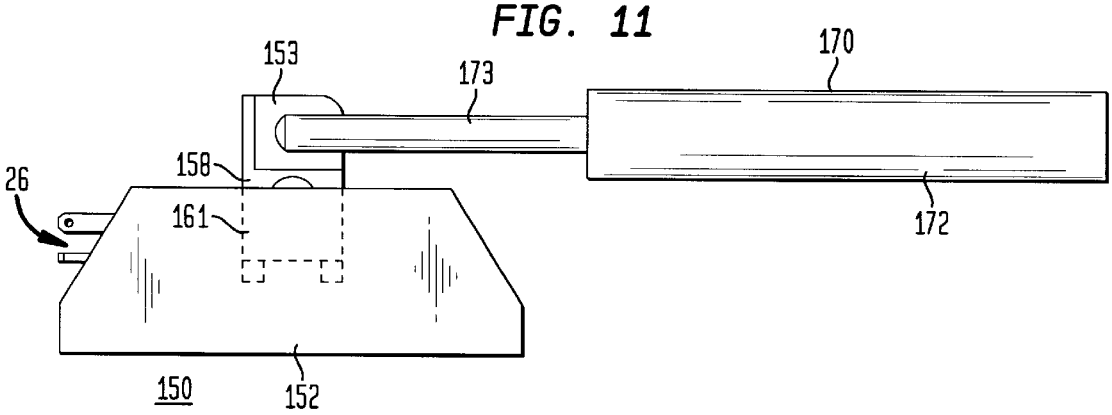
FIGS. 11 and 12 are end views as shown in FIG. 10 with the coupler engaged with the receiver portion, and further showing extended and retracted states of a telescopic mounting arrangement, respectively.
Figure 12:
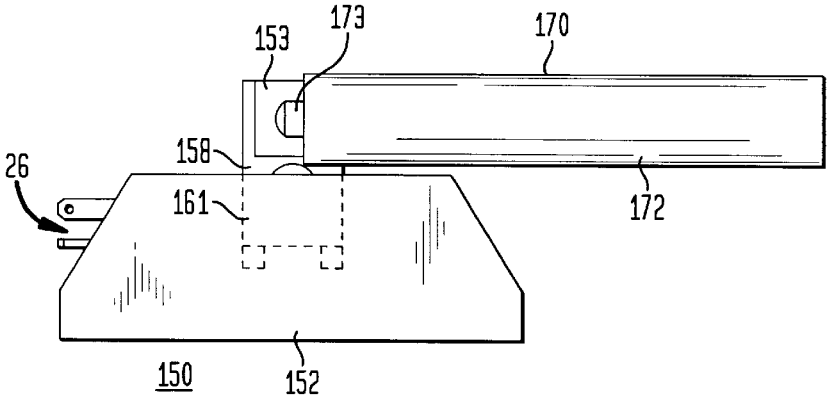

FIGS. 11 and 12 are respective side representations of the embodiment of FIG. 10, showing a telescopic mounting arrangement 170 in extended and retracted conditions. As shown in these figures, telescopic mounting arrangement 170 is formed, in this embodiment, of a stationary portion 172 which is mounted to the mounting surface (not shown). Such mounting may permit other degrees of freedom of movement, such as pivoting, or may take the form of direct anchoring.

Figure 13:
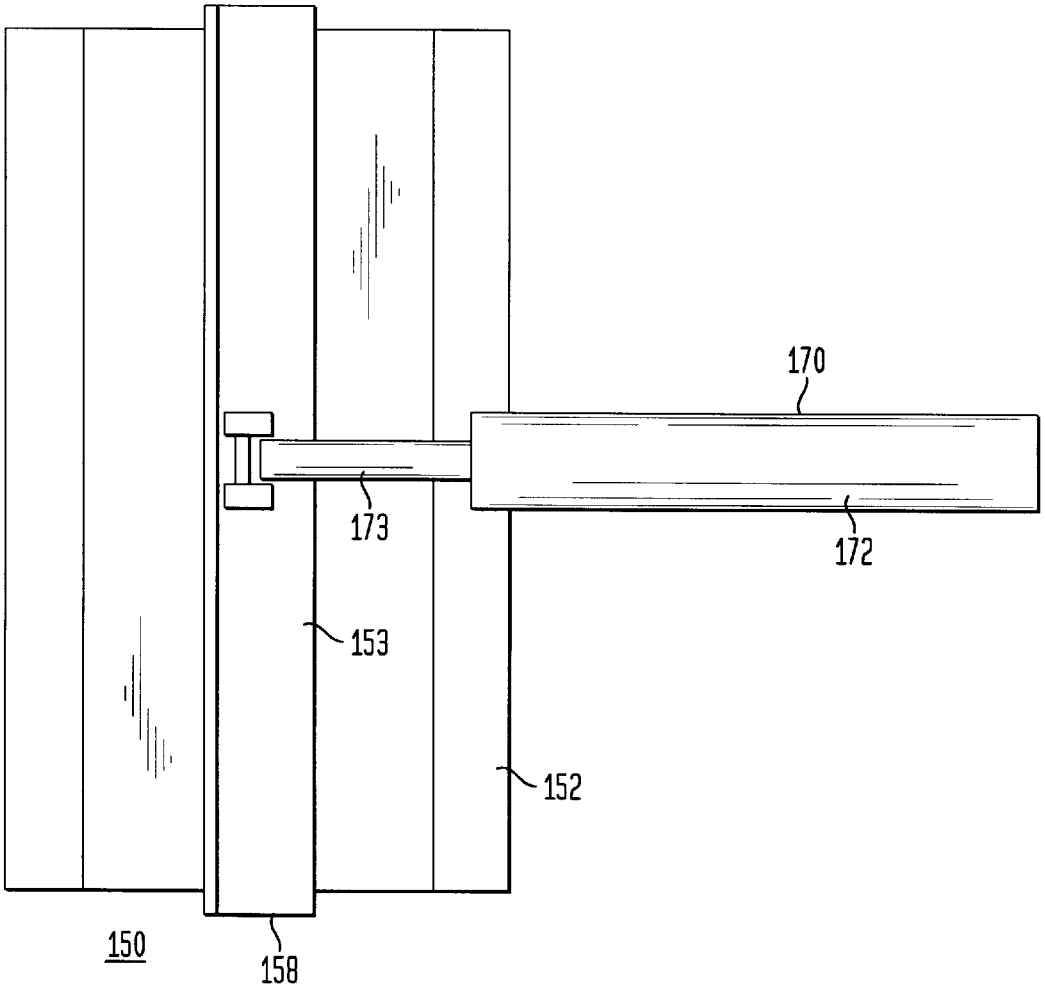
FIG. 13 is a top view of the embodiment of FIGS. 11 and 12.

There is contained within stationary portion 172 a telescopically extendable portion 173 which is shown to be coupled to attachment element 153. FIG. 13 is a top plan view of lighting system 150 showing in greater detail the interconnection between telescopic extending portion 173 and attachment element 153. As shown, in this embodiment of the invention, the coupling is effected pivotally.

Figure 14:
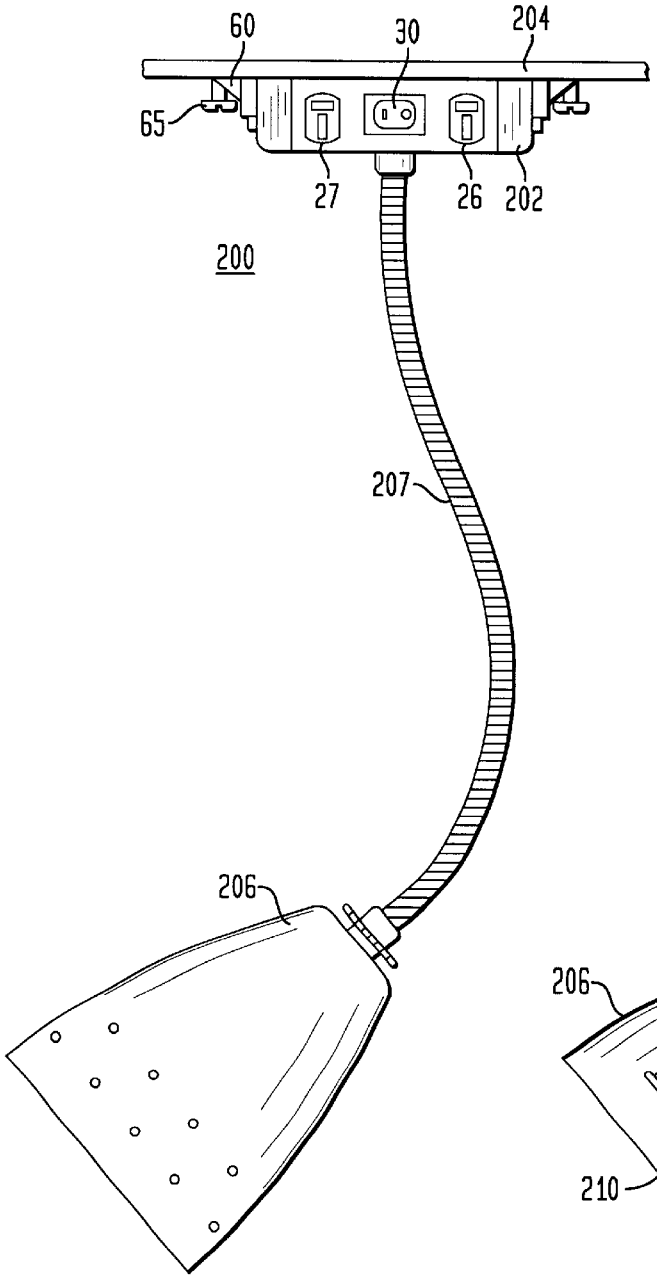
FIGS. 14 and 15 are views of respective sides of an embodiment of the invention having a gooseneck that couples a lighting fixture to a base.
Figure 15:
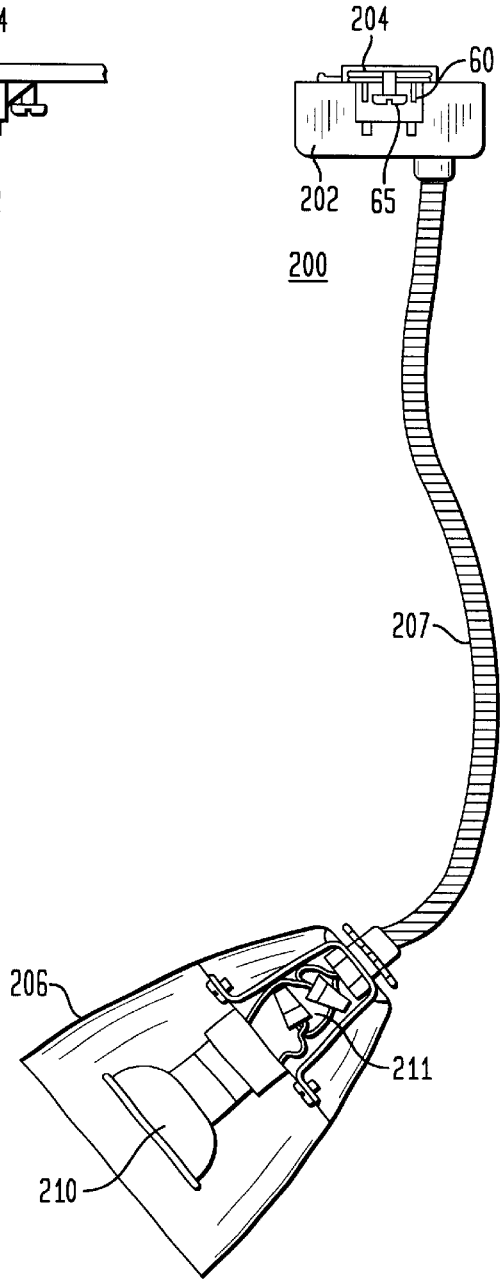

FIGS. 14 and 15 are respective side views of a lighting system 200 having a base housing 202 that is coupled to a mounting track 204 (shown in FIG. 14 only). Elements of structure that previously have been discussed are similarly designated. In this embodiment, base housing 202 employs a coupler 60 and threaded fastener 65 as described hereinabove in FIG. 3D.

A lighting fixture 206 is coupled via a gooseneck 207 to base housing 202. FIG. 15 shows the lighting fixture in fragmented form wherein a high output lamp 210 and associated circuitry 211 are shown to be disposed within the lighting fixture. A plurality of electrical conductors (not shown) extend through gooseneck 207 and couple high output lamp 210 electrically to switch 30 and male and female electrical connectors 26 and 27.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A lighting system for installation on a mounting surface, the lighting system being of the type having at least one lighting fixture having a housing with a lamp therein, the housing having a roof, and first and second exterior sides at respective first and second ends thereof, the lighting system comprising:

a first receiver portion formed integrally with the housing and coupled to the first exterior side of the lighting fixture, said receiver portion defining a receiver aperture extending along the first exterior side of the lighting fixture;

a first coupler having:

a mounting portion for coupling with the mounting surface; and an engagement portion for engaging resiliently and latchingly with said first receiver portion;

a second receiver portion coupled to the second exterior side of the lighting fixture, said second receiver portion defining a receiver aperture extending along the second exterior side of the lighting fixture, and a second coupler having:

a second mounting portion for coupling with the mounting surface, and a second engagement portion for engaging with the second receiver portion, whereby the lighting system is affixed at the first and second ends to the mounting surface.

2. The lighting system of claim 1, wherein said mounting portion and said engagement portion of said first coupler are integrally formed.

3. The lighting system of claim 2, wherein said first coupler is formed of a plastic material.

4. The lighting system of claim 1, wherein there is provided a further lighting fixture, the lighting fixture and the further lighting fixture each being provided with a first electrical connector for receiving electrical energy.

5. The lighting system of claim 4, wherein the lighting fixture and the further lighting fixture each are provided with a switch for controlling the delivery of electrical energy thereto.

6. The lighting system of claim 4, wherein the lighting fixture and the further lighting fixture each are provided with a second electrical connector, whereby the lighting fixture and the further lighting fixture are electrically interconnected in a daisy-chain fashion.

7. The lighting system of claim 6, wherein the lighting fixture and the further lighting fixture each are independently controllable.

8. The lighting system of claim 1, wherein the lighting fixture is provided with:

a high-output lamp;

a lamp socket for accommodating said high-output lamp, and a lamp support for supporting the lamp in a predetermined orientation.

9. The lighting system of claim 8, wherein said lamp support comprises a shoulder portion integrally formed with said lamp socket.

10. The lighting system of claim 1, wherein there is further provided an elongated support attachment having first and second ends coupled to respective mounting portions of said first and second couplers.

11. The lighting system of claim 10, wherein said elongated support attachment and said first and second couplers are integrally formed.

12. The lighting system of claim 10, wherein there is further provided a telescopic displacement arrangement having first and second telescopically displaceable engaged portions for coupling said elongated support attachment to the mounting surface, whereby said elongated support attachment and the lighting fixture coupled thereto can be positioned at a determined variable distance with respect to the mounting surface.

* * * * *